US008276672B2

(12) United States Patent
Buckle

(10) Patent No.: US 8,276,672 B2
(45) Date of Patent: Oct. 2, 2012

(54) BIMETALLIC DIAPHRAGM FOR TRAPPED FLUID EXPANSION

(75) Inventor: Kevin G. Buckle, Aberdeenshire (GB)

(73) Assignee: Vetco Gray Inc., Houston, TX (US)

( * ) Notice: Subject to any disclaimer, the term of this patent is extended or adjusted under 35 U.S.C. 154(b) by 281 days.

(21) Appl. No.: 12/719,926

(22) Filed: Mar. 9, 2010

(65) Prior Publication Data

US 2010/0307764 A1 Dec. 9, 2010

Related U.S. Application Data

(60) Provisional application No. 61/183,699, filed on Jun. 3, 2009.

(51) Int. Cl.
*E21B 33/043* (2006.01)

(52) U.S. Cl. ..... 166/368

(58) Field of Classification Search ..... 166/91.1, 166/337, 336, 368
See application file for complete search history.

(56) References Cited

U.S. PATENT DOCUMENTS

| | | | | |
|---|---|---|---|---|
| 3,827,486 | A * | 8/1974 | Hall | 166/359 |
| 5,884,706 | A * | 3/1999 | Edwards | 166/335 |
| 5,988,282 | A * | 11/1999 | Jennings et al. | 166/348 |
| 6,050,339 | A | 4/2000 | Milberger | |
| 6,494,257 | B2 | 12/2002 | Bartlett et al. | |
| 6,655,455 | B2 | 12/2003 | Bartlett et al. | |
| 6,681,850 | B2 | 1/2004 | Bartlett et al. | |
| 7,069,988 | B2 | 7/2006 | Bartlett et al. | |
| 7,096,937 | B2 | 8/2006 | Bartlett et al. | |

* cited by examiner

*Primary Examiner* — Kenneth L Thompson
(74) *Attorney, Agent, or Firm* — Bracewell & Giuliani LLP

(57) ABSTRACT

A subsea well tubular member has an axial passage with upper and lower retrievable plugs releasably mounted in the passage, the plugs having ends facing each other. A cavity is formed on one of the ends of one of the plugs. A movable barrier is mounted sealingly over the cavity, the barrier being movable repeatedly between inner and outer positions in response to temperature changes. The inner position reduces a volume of the cavity and increases a volume of a trapped fluid space between the ends of the plugs. The outer position increases the volume of the cavity and decreases the volume of the trapped fluid space. The barrier has two metallic layers with different coefficients of expansion.

17 Claims, 2 Drawing Sheets

BIMETALLIC DIAPHRAGM FOR TRAPPED FLUID EXPANSION

CROSS-REFERENCE TO RELATED APPLICATION

This application claims priority to provisional application 61/183,699, filed Jun. 3, 2009.

FIELD OF THE INVENTION

This invention relates in general to subsea well production trees, and in particular to a bimetallic diaphragm located in an area containing a trapped volume of fluid subject to expansion and contraction due to temperature changes.

BACKGROUND OF THE INVENTION

One type of subsea wellhead assembly has a production tree mounted to a wellhead housing at the upper end of the well. In one type of production tree, referred to as a horizontal tree, a tubing hanger lands in the production tree. The tubing hanger supports a string of tubing and has an axial passage that receives the flow of well fluid. The axial passage has a lateral outlet between upper and lower ends of the axial passage. The lateral outlet registers with a lateral outlet in the production tree. At least one plug is secured in the axial passage above the lateral outlet to cause the well fluid to flow out the lateral outlet. The plug is retrievable and normally installed and retrieved with a wireline.

For safety reasons, at least two pressure barriers are located in the tree to prevent well fluid from flowing above the tubing hanger. The first pressure barrier is considered to be the wireline plug. In some installations, a tree cap is installed in the bore of the production tree above the tubing hanger to serve as the second pressure barrier. In other installations, a second wireline plug is installed in the tubing hanger passage above the first plug. The second or upper wireline plug is considered to be the second pressure barrier.

The axial passage in the tubing hanger contains a liquid before the upper plug is lowered in place above the lower plug. Normally, there is no outlet leading to the space in the passage between the plugs, thus the liquid will be trapped. During production, the well fluid flowing up the tubing can be at elevated temperatures because of the temperature of the producing formation. The elevated temperature can cause the liquid in the trapped fluid space to expand. The expansion would cause the pressure within the trapped fluid space to rise and could result in leakage across the seals of one or both of the wireline plugs. When the well is shut in, the temperature will drop because of the cool temperature of the sea water at the sea floor. The liquid in the trapped fluid space shrinks and the pressure drops. This reduction in pressure could cause sea water to be drawn across the seals of the upper plug. The cycling of temperature can damage the seals, reducing the effectiveness of the plugs as being pressure barriers.

SUMMARY

A subsea wellhead assembly has a tubular member with a passage containing first and second plugs. The plugs define a sealed trapped fluid space between them that is filled with a liquid. A cavity is formed in the first plug. A barrier is mounted to the first plug sealingly over the cavity and in fluid communication with the liquid in the trapped fluid space. The barrier is movable repeatedly between inner and outer positions in response to temperature changes. The inner position reduces a volume of the cavity and increases a volume of the trapped fluid space to prevent excessive pressure occurring due to a temperature increase. The outer position increases the volume of the cavity and decreases the volume of the trapped liquid space to avoid a vacuum occurring.

Preferably, the barrier is immovable in response to an increase in hydrostatic pressure while the first plug is lowered from a surface vessel into wellhead assembly. In the preferred embodiment, the barrier comprising a metallic diaphragm having a convex outer surface and a concave inner surface. More particularly, the barrier has at least two metallic layers, with one of the metallic layers having a different coefficient of thermal expansion than the other.

The cavity may be filled with a compressible fluid. In one embodiment, the cavity is filled with a compressible fluid at an elevated pressure prior to the first plug being lowered subsea from a surface vessel.

DETAILED DESCRIPTION OF THE INVENTION

Figure 1:
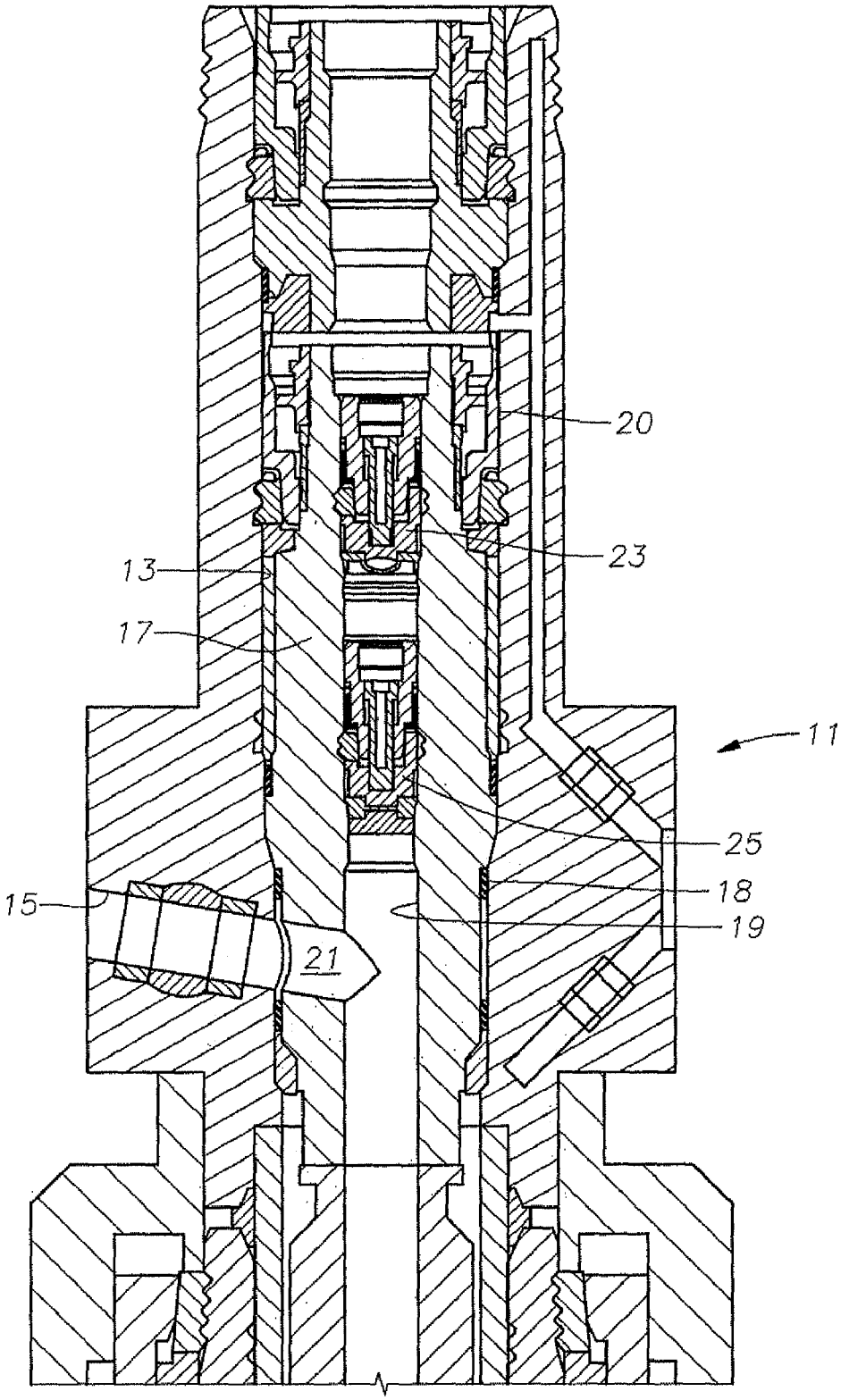
FIG. 1 is a sectional view of a portion of a subsea tree having a bimetallic diaphragm installed in accordance with this invention.

Referring to FIG. 1, a production tree 11 is installed at the seafloor at the upper end of a well. Production tree 11 has a bore 13 that extends through it along the longitudinal axis of tree 11. A production outlet 15 extends from tree bore 13 laterally outward. A tubing hanger 17 lands in tree bore 13 and is secured to a string of production tubing (not shown) for the flow of well fluid from the well. Tubing hanger 17 has an axial passage 19, and a lateral passage 21 extends laterally outward from axial passage 19. Lateral passage 21 registers with production outlet 15. Seals 18 above and below lateral passage 21 seal the junction of tubing hanger lateral passage 21 with production outlet 15. A lockdown mechanism 20 locks tubing hanger 17 in tree bore 13. Tree 11 has various valves and other equipment for controlling production of the well.

Figure 2:
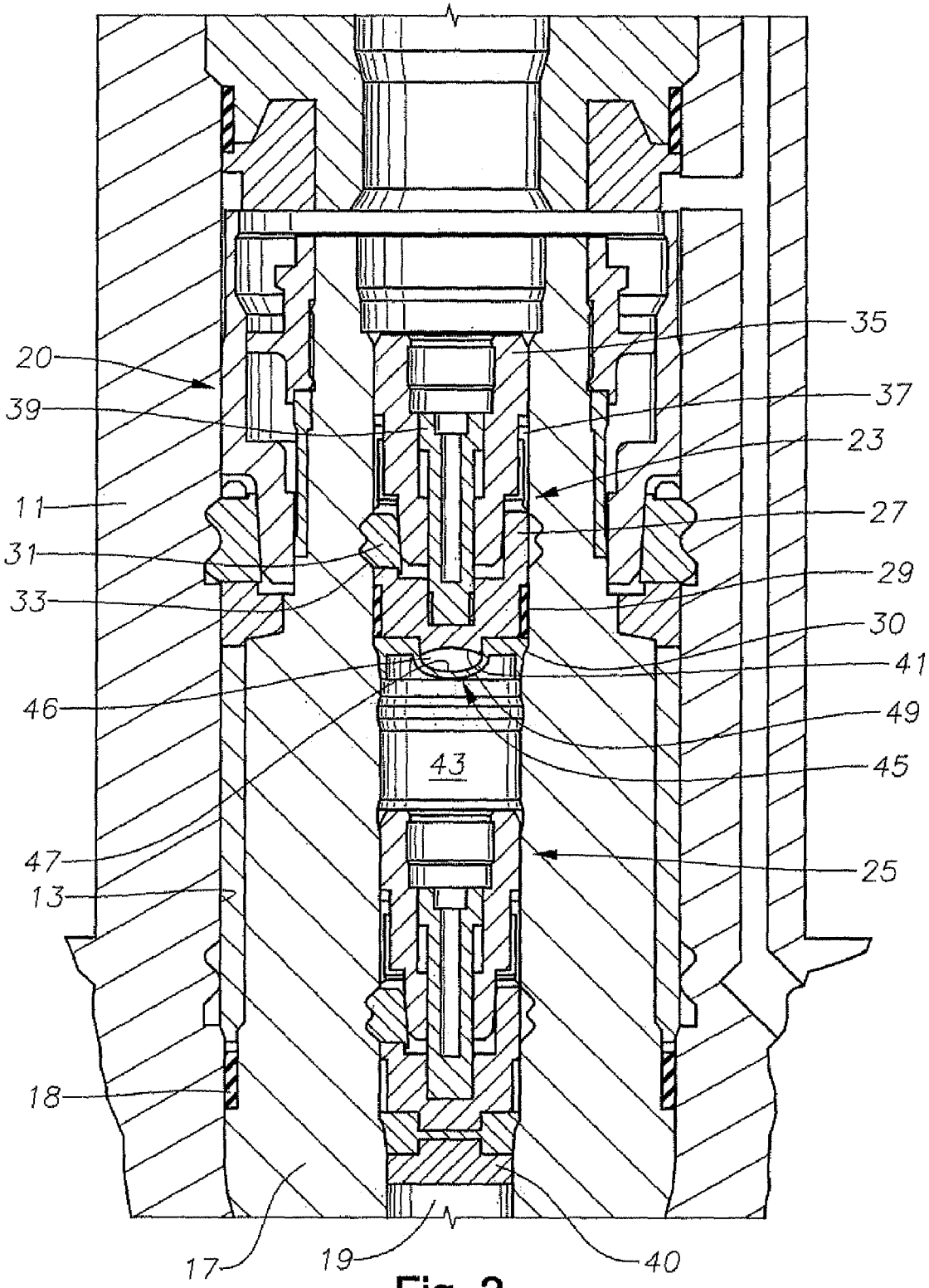
FIG. 2 is an enlarged view of a portion of the tree of FIG. 1.

Referring to FIG. 2, in this embodiment, an upper crown plug 23 and a lower crown plug 25 are installed in tubing hanger axial passage 19 above lateral passage 21. Upper and lower crown plugs 23, 25 are typically installed and removed by a running tool (not shown) deployed on wireline, drill pipe or coiled tubing. Upper and lower crown plugs 23, 25 may be a variety of different types. In the example shown, each has a plug body 27 with a plug seal or elastomeric packing 29 located on the exterior for sealing against the sidewall of tubing hanger axial passage 19. In this embodiment, a metal seal ring 30 secures to plug body 27 below packing 29, thereby retaining packing 29 on plug body 27. Seal ring 30 has a depending lip that forms a metal-to-metal seal with a shoulder in axial passage 19. Each crown plug 23, 25 has a lock member, such as a split ring or dogs 31, which is moved radially outward into engagement with a profile 33 in tubing hanger axial passage 19.

Each plug 23, 25 has an actuator 35 with a tapered surface that mates with dogs 31. When moved downward, actuator 35 forces dogs 31 radially outward into profile 33. In this example, a ratchet member 37 is mounted to body 27 and extends upward alongside ratchet member 37. Each ratchet member 37 comprises a collet finger with teeth on its upper end that face inward. Actuator 35 has circumferential grooves on its exterior, and the teeth of ratchet member 37 are biased inward against these grooves. As actuator 35 moves downward, ratchet members 37 ratchet against the grooves. The saw-tooth shapes of the teeth and grooves resist actuator 35 from moving upward, retaining actuator 35 in the lower, locked position. An axially extending bolt 39 secures to threads in body 27 and extends upward into a central cavity within actuator 35. Actuator 35 is axially movable relative to body 27 and bolt 39. Bolt 39 has an enlarged head that retains actuator 35 with body 27 during run-in and retrieval.

Lower crown plug 25 has an optional protective plate 40 on its lower end attached to metal seal ring 30. Plate 40 protects lower crown plug 25 from wear due to rapidly flowing well fluid flowing up axial passage 19 and out lateral passage 21. Crown plugs 23, 25 could have a variety of different locking mechanisms and seals.

After upper and lower crown plugs 23, 25 are set, a trapped fluid space 43 will be located in axial passage 19 between them. Space 43 will normally be filled with the same fluid that was located within axial passage 19 when crown plugs 23, 25 were set, which may be well fluid or water. In this embodiment, there is no vent for space 43, thus the fluid within it is trapped. Initially the pressure of the trapped fluid in space 43 will be substantially at the same hydrostatic pressure as the fluid directly above packing 29. A tree cap (not shown) could be installed and sealed in tree bore 13 above tubing hanger 17, but fluid would remain between the seal of the tree cap and upper crown plug 23, and that fluid would be at the hydrostatic pressure based on the depth of the water where production tree 11 is installed. Consequently, the trapped fluid in space 43 between crown plugs 23, 25 would also initially be at the hydrostatic pressure of the sea water surrounding tree 11.

During production of the well, the well fluid flowing out lateral passage 21 may be elevated in temperature, possibly up to 275 degrees F. or more. This heat will transfer and increase the temperature of the trapped fluid in space 43, causing it to expand. The expansion could result in a substantial increase in the pressure of the fluid in space 43, creating a high differential pressure across seals 29 and 30. The high differential pressure could damage seals 29, 30 or result in leakage of trapped fluid out of space 43. When the well is shut in and cools, the temperature of the trapped fluid in space 43 could drop to the ambient temperature of the sea water. This drop contracts the fluid in space 43 and thus lowers the pressure of the fluid in space 43. If some of the fluid in space 43 had been expelled during the elevated temperature phase, there would be less fluid in space 43 when it cools than the initial volume. This could result in a lower pressure within trapped fluid space 43 than the hydrostatic pressure above upper plug 23. If sufficiently lower, it could create a vacuum that would cause fluid to flow across seals 29 and 30 into trapped fluid space 43. Repeated cycles of expelling fluid during production and drawing in fluid during cooling could damage the seals 29, 30, and prevent them from properly sealing.

At least one or both of crown plugs 23 or 25 has a trapped fluid pressure relieving device in fluid communication with trapped fluid space 43 to prevent this occurrence. In this example, the device is located on the lower end of upper crown plug 23. The device includes a cavity 41, which is formed on a lower end of body 27 and surrounded by a seal ring 30, which may be metal or elastomeric. Cavity 41 is concave in this example, but need not be a true segment of a sphere. Cavity 41 has an outer diameter in this example equal to the inner diameter of metal seal 30.

A bimetallic diaphragm 45 is mounted below cavity 41 and sealed around the perimeter of cavity 41 to define a sealed void 46. Diaphragm 45 is preferably secured to metal seal ring 30, but alternately it could be secured to plug body 27. Diaphragm 45 has two or more metallic layers, including an inner layer 47 and an outer layer 49, and they may be formed of conventional metals with significantly different coefficients of expansion, such as metals used in thermostats. In this example, the natural shape of diaphragm 45 when initially installed is concave on its side facing cavity 41 and convex on its opposite side. In this embodiment, the radius of cavity 41 and the inner radius of inner layer 47 are approximately the same. When in the initial installed position and viewed in cross-section, as shown in FIG. 2, void 46 between cavity 41 and inner layer 47 is generally elliptical. The initial volume of the void 46 between cavity 41 and bimetallic diaphragm 45 is selected to equal or exceed the expected amount expansion of the fluid in trapped fluid space 43 if the temperature rises to the maximum expected.

Preferably, an arrangement is made so that bimetallic diaphragm 45 does not deflect toward cavity 41 in response to the increase in hydrostatic pressure that occurs as upper crown plug 23 is being run. Ideally, once crown plug 23 is installed in tubing hanger 17, bimetallic diaphragm 45 will be spaced from cavity 41 about the same amount as during initial installation of diaphragm 45 to upper plug 23. This arrangement could be made in several ways.

For example, layers 47, 49 of bimetallic diaphragm 46 could be made stiff enough such that they do not deflect significantly toward cavity 41 in response to the expected hydrostatic fluid pressure increase on the outer layer 49 during run-in. In that instance, void 46 could contain either a compressible fluid, such as air or an inert gas such as nitrogen. The pressure within void 46 initially could be atmospheric. Alternatively, void 46 could be evacuated.

In an alternate arrangement, a spring could be employed to prevent bimetallic diaphragm 45 from deflecting inward due to the increase in hydrostatic pressure as crown plug 23 is being run. In that instance, void 46 could either be evacuated initially or left at atmospheric pressure.

In another alternate arrangement, void 46 between diaphragm 45 and cavity 41 could contain a compressible fluid, such as air or an inert gas such as nitrogen, under an initial installation pressure. Void 46 would be pressurized during installation of diaphragm 45 to the approximate hydrostatic pressure expected, or slightly less, when crown plug 23 is installed in subsea tree 11. The pressurization could be performed prior to installation of crown plug 23 by a pump injecting a fluid through an injection port having a valve.

During completion of the well, lower crown plug 25 is first installed, such as on a wireline, then upper crown plug 23. As upper crown plug 23 is being lowered into axial passage 19, bimetallic diaphragm 45 will be acted on by hydrostatic pressure. However, one of the arrangements mentioned above will be employed to prevent significant shrinkage of void 46 due to hydrostatic pressure. Also, the temperature within the tubing hanger axial passage 19 will be cooler than the temperature when diaphragm 45 was initially installed. The different thermal expansion coefficients of layers 47, 49 may tend to cause bimetallic diaphragm 45 to deflect farther away from cavity 41, increasing the volume of void 46. Before any production of the well, ideally bimetallic diaphragm 45 is spaced from contact with cavity 41 by the same amount or more as during initial installation.

As the well begins to produce, the well fluid flowing up axial passage 19 and out lateral passage 21 will be an elevated temperature above the ambient sea water due to the temperature of the producing formation. The heat will cause the fluid trapped in space 43 to increase in temperature as well. This temperature increase causes the fluid in trapped fluid space 43 to increase in volume. The additional pressure caused by the increase in volume plus the effect of heat on bimetallic diaphragm 45 causes bimetallic diaphragm 45 to deflect upward toward cavity 41. The upward deflection decreases the volume of void 46 and increases the volume of trapped fluid space 43. This increase in volume of trapped fluid space 43 reduces the increase in pressure of the trapped fluid that would otherwise occur. Bimetallic diaphragm 45 continues to deflect upward as the temperature rises because of the different coefficients of thermal expansion of its layers 47, 49. At the maximum expected temperature, bimetallic diaphragm 45 will be in contact or nearly in contact with cavity 41, the volume of void 46 will be at a minimum, and the pressure in trapped fluid space 43 will be substantially the same or only slightly elevated from its initial hydrostatic pressure.

When the well is shut in, the temperature will decrease and the volume of trapped fluid in space 43 contracts. As the temperature decreases, the different coefficients of thermal expansion of bimetallic diaphragm 45 cause it to deflect downward, away from cavity 41 and increasing the volume of void 46. This deflection reduces the volume of trapped fluid space 43 and tends to prevent the pressure of the fluid trapped in space 43 from decreasing below the initial hydrostatic fluid pressure. The pressure differentials across seals 29, 30 of plugs 23, 25 remain within acceptable limits during the shut-in and production cycles.

Although shown attached to upper plug 23, bimetallic diaphragm 45 could alternately be attached to the upper end of lower crown plug 25. Furthermore, bimetallic diaphragm 45 could be employed in other areas with subsea production equipment that have trapped fluid spaces between seals.

Bimetallic diaphragm 45 deflects to increase the volume of trapped fluid space 43 in response to an increase in pressure of the fluid in trapped fluid space 43, the increase in pressure being due to an increase in temperature. The bimetallic layers 47, 49 of diaphragm 45 insures that it deflects back and regains its original profile upon cooling. It further enables repeated use during start up and shut down conditions, which initiate temperature increase and decrease in the trapped fluid space 43. Unlike an element that ruptures, there is no need to replace bimetallic diaphragm 45 after one elevation in temperature of the fluid in trapped fluid space 43.

While the invention has been described in only a few of its forms, it should be apparent to those skilled in the art that it is not so limited, but is susceptible to various changes without departing from the scope of the invention. For example, the bimetallic diaphragm could be configured as a self-contained unit that could be mounted in any trapped volume cavity susceptible to pressure increases due to temperature fluctuations.

The invention claimed is:

1. In a subsea wellhead assembly having a tubular member having a passage and first and second plugs mounted in the passage, defining a sealed trapped fluid space between the plugs that is filled with a liquid, the improvement comprising:

a barrier sealingly mounted to the first plug, defining a sealed void between the barrier and the first plug, and the barrier being in fluid communication with the liquid in the trapped fluid space, the barrier being movable repeatedly between inner and outer positions in response to temperature changes, the inner position reducing a volume of the sealed void and the outer position increasing the volume of the sealed void; and wherein the first plug has a cavity over which the barrier is sealingly mounted, the cavity forming a part of the sealed void.

2. The wellhead assembly according to claim 1, wherein the barrier is movable from the inner position to the outer position in response to a decrease in temperature.

3. The wellhead assembly according to claim 1, wherein the barrier is immovable in response to an increase in hydrostatic pressure while the first plug is lowered from a surface vessel into wellhead assembly.

4. The wellhead assembly according to claim 1, wherein the barrier comprises a metallic diaphragm having a convex outer surface and a concave inner surface.

5. The wellhead assembly according to claim 1, wherein the barrier comprises a dome-shaped diaphragm having at least two metallic layers with different coefficients of thermal expansion.

6. The wellhead assembly according to claim 1, wherein the sealed void is filled with a compressible fluid.

7. The wellhead assembly according to claim 1, wherein the sealed void is filled with a compressible fluid at an elevated pressure over atmospheric pressure prior to the first plug being lowered subsea from a surface vessel.

8. A subsea wellhead assembly, comprising:

a tubular member having a passage;

upper and lower retrievable plugs releasably mounted in the passage, the upper plug having a lower end facing and axially spaced from an upper end of the lower plug; and a movable barrier mounted to one of the ends of one of the plugs, defining a sealed void, the barrier being movable repeatedly between inner and outer positions in response to temperature changes in the passage, the inner position reducing a volume of the sealed void and the outer position decreasing a volume of the sealed void; and wherein the barrier comprises a metallic diaphragm having a convex outer surface and a concave inner surface.

9. The wellhead assembly according to claim 8, wherein the metallic diaphragm is dome-shaped and has at least two metallic layers with different coefficients of thermal expansion.

10. The wellhead assembly according to claim 8, wherein the sealed void is filled with a compressible fluid.

11. The wellhead assembly according to claim 8, wherein the sealed void is filled with a compressible fluid at an elevated pressure over atmospheric pressure prior to the plugs being lowered from a surface vessel into the wellhead assembly.

12. The wellhead assembly according to claim 8, wherein the wellhead assembly further comprises:

a subsea production tree having a bore; and wherein the tubular member comprises:

a tubing hanger landed within the bore of the tree.

13. The wellhead assembly according to claim 8, wherein the barrier is immovable in response to an increase in hydrostatic pressure while the upper plug is lowered from a surface vessel into the tubular member.

14. A method producing well fluid from a subsea well, comprising:

(a) mounting a tubing hanger in a wellhead assembly of the well, the tubing hanger having an axial passage with a laterally extending outlet located between upper and lower ends of the axial passage;

(b) securing first and second plugs in the passage above the outlet, defining a trapped fluid space between the plugs, a movable barrier being mounted sealingly to the first plug, defining a sealed void, the barrier being exposed to liquid in the trapped fluid space;

(c) flowing well fluid up through the tubing hanger and out the outlet, the well fluid causing the liquid in the trapped fluid space to increase in temperature;

(d) moving the barrier inward to decrease a volume of the sealed void in response to the increase in temperature, thereby increasing a volume of the trapped fluid cavity; and wherein step (b) comprises lowering the first plug from a surface vessel into the tubing hanger and preventing the barrier from moving inward in response to an increase in hydrostatic pressure as the first plug is being lowered.

15. The method according to claim 14, further comprising:

after steps (c) and (d), ceasing to flow well fluid, which causes the temperature of the fluid in the trapped fluid space to decrease in temperature; and moving the barrier outward to increase the volume of the sealed void in response to the decrease in temperature, thereby decreasing a volume of the trapped fluid cavity.

16. The method according to claim 14, wherein step (b) further comprises filling the sealed void with a compressible fluid.

17. The method according to claim 14, wherein step (b) further comprises filling the sealed void with a compressible fluid at an elevated pressure over atmospheric pressure, then lowering the first plug from a surface vessel into the tubing hanger.

* * * * *